US005950244A

United States Patent [19]

Fournier et al.

[11] Patent Number: 5,950,244

[45] Date of Patent: Sep. 14, 1999

[54] PROTECTIVE DEVICE FOR IMPACT MANAGEMENT

[75] Inventors: Eric Fournier, Granby; Evangelos Spyrou, Montreal; T. Blaine Hoshizaki, Lasalle, all of Canada

[73] Assignee: Sport Maska INC., Quebec, Canada

[21] Appl. No.: 09/094,217

[22] Filed: Jun. 9, 1998

Related U.S. Application Data

[60] Provisional application No. 60/072,371, Jan. 23, 1998.

[51] Int. Cl.[6] ..... A42B 3/00; A42B 3/10

[52] U.S. Cl. ..... 2/414; 2/411; 2/425

[58] Field of Search ..... 2/410, 411, 412, 2/414, 415, 420, 425, 417, 418, 419

[56] References Cited

U.S. PATENT DOCUMENTS

| | | | |
|---|---|---|---|
| 3,729,744 | 5/1973 | Rappleyea . | |
| 3,783,450 | 1/1974 | O'Connor . | |
| 3,820,163 | 6/1974 | Rappleyea . | |
| 3,946,441 | 3/1976 | Johnson . | |
| 4,006,496 | 2/1977 | Marker . | |
| 4,081,865 | 4/1978 | Bergee et al. . | |
| 4,133,055 | 1/1979 | Zebuhr | 2/411 |
| 4,134,155 | 1/1979 | Robertson | 2/412 |
| 4,345,338 | 8/1982 | Frieder et al. | 2/414 |
| 4,484,364 | 11/1984 | Mitchell et al. . | |
| 4,534,068 | 8/1985 | Mitchell et al. . | |
| 4,558,470 | 12/1985 | Mitchell et al. . | |
| 5,086,520 | 2/1992 | Arai . | |
| 5,269,025 | 12/1993 | Broersma | 2/411 |
| 5,309,576 | 5/1994 | Broersma . | |
| 5,351,342 | 10/1994 | Garneau . | |
| 5,428,846 | 7/1995 | Socci et al. | 2/425 |
| 5,581,819 | 12/1996 | Garneau | 2/421 |
| 5,619,756 | 4/1997 | Garneau . | |
| 5,669,079 | 9/1997 | Morgan . | |
| 5,815,846 | 10/1998 | Calonge | 2/413 |
| 5,833,796 | 11/1988 | Matich | 2/425 |

FOREIGN PATENT DOCUMENTS

| | | | |
|---|---|---|---|
| 423711 | 4/1991 | European Pat. Off. | 2/411 |
| 571065 | 11/1993 | European Pat. Off. | 2/411 |
| 405093308 | 4/1993 | Japan | 2/411 |
| 7709104 | 8/1977 | Netherlands | 2/411 |

*Primary Examiner*—John J. Calvert
*Assistant Examiner*—Tejash D Patel
*Attorney, Agent, or Firm*—Factor and Shaftal

[57] ABSTRACT

A protective device comprising a shell and a liner. The shell includes an interior surface. The liner is associated with the interior surface of the shell. The liner includes a member for enabling control displacement of the preselected regions of the liner upon various degrees of impact of the protective device. The control displacement member comprises a first member and a second member. Each of the first and second members having a top surface, a bottom surface and a different impact absorbing characteristic. The top surface of at least one of the first and second members is associated with the interior surface of the shell. At least a portion of the bottom surface of the first member extends further from the interior surface of the shell and the bottom surface of the second member.

20 Claims, 4 Drawing Sheets

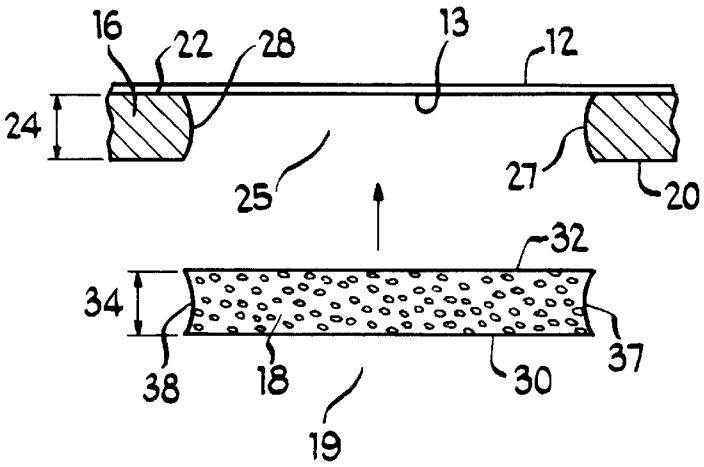
Fig 4
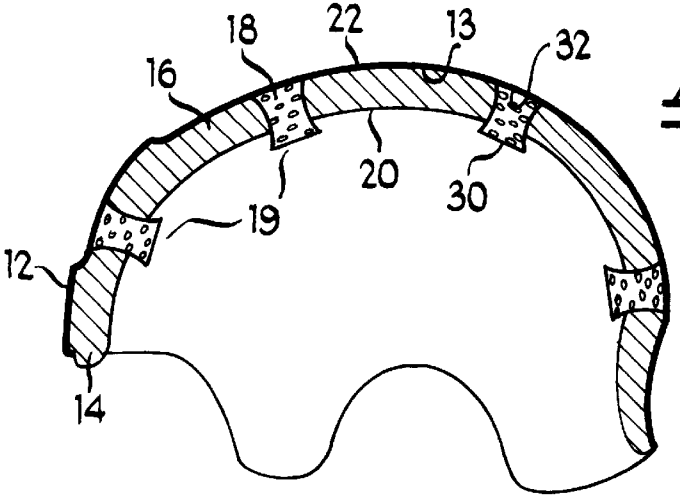
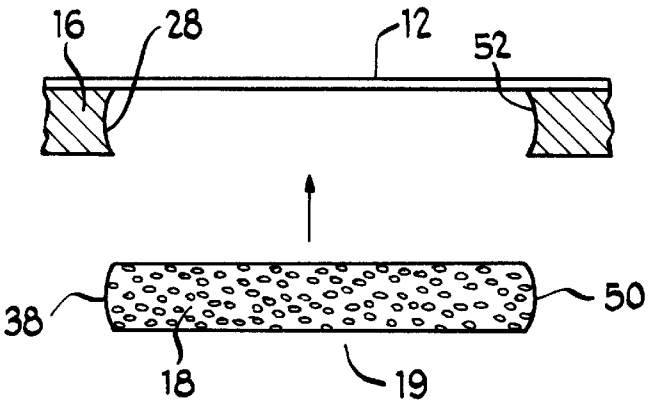
Fig 5
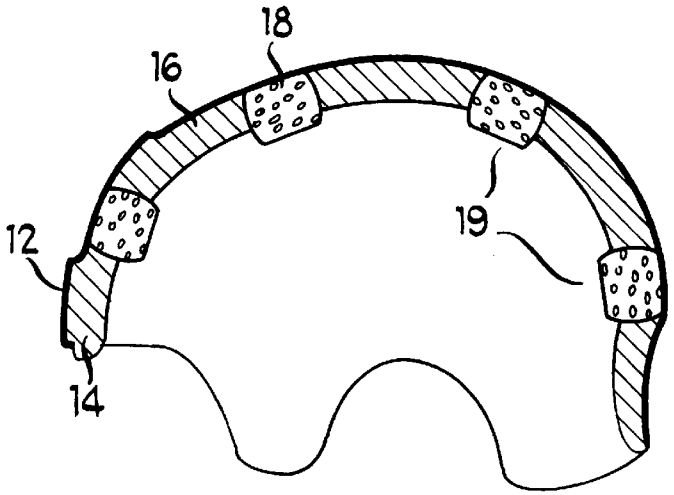

PROTECTIVE DEVICE FOR IMPACT MANAGEMENT

This application claims priority from Provisional Patent Application Ser. No. 60/072,371 filed Jan. 23, 1998.

BACKGROUND OF THE INVENTION

1. Field of the Invention

The present invention relates in general to a protective device and, more particularly, to an impact absorbing liner for use in a protective helmet to, in turn, provide impact management over an extended period of time.

2. Background Art

Protective helmets have been know in the art for many years. In particular, many of these protective helmets are constructed of multiple layers of impact absorbing material. Likewise, protective helmets fabricated from materials with different impact absorbing characteristics are also know in the art. These helmets provide both increased comfort for the helmet wearer and increased ability of the helmet to absorb different impacts.

For instance, both Johnson, U.S. Pat. No. 3,946,441, and Marker, U.S. Pat. No. 4,006,496 show a safety helmet with a hard outer shell, and a shock-absorbing inner shell made of two different materials. The different materials each appear to have different impact absorbing properties, for performance during a range of different impact loads. The helmets also have a fitting pad to encircle the wearer's head for increased fit and comfort. Likewise, Mitchell et al., in U.S. Pat. No. 's 4,534,068 and 4,558,470, appear to disclose a shock attenuation system for use with protective headgear wherein on outer shell is lined with a shock absorbing layer, a layer of flexible slow recovery foam, and a layer of rapid recovery foam.

Moreover, Garneau, in U.S. Pat. No. 5,351,342, appears to disclose a safety helmet which comprises of a hard outer shell, a shock absorbing insert for contact with the wearer's head, and a hard inner shell embedded in the shock absorbing insert for additional impact protection. The hard inner shell has fingers which project through the inner face of the shock absorbing insert so as to come flush with the inner face of the insert, to better anchor the hard inner shell within the insert. Finally, both Morgan, U.S. Pat. No. 5,669,079, and Broersma, U.S. Pat. No. 5,309,576, appear to disclose a protective helmet with a hard outer shell, an impact absorbing liner, and a material with separate impact absorbing characteristics imbedded or inserted into the liner material.

Although these and other conventional helmet liners have worked well, they have failed to provide protection against both high and low degrees of impact imparted on a helmet, over the extended life of a helmet. Moreover, it is always a goal in the art to increase the impact absorption and dissipation capabilities of protective helmets.

SUMMARY OF THE INVENTION

The invention comprises a protective device which includes a shell and a liner. The shell includes an interior surface. The liner is associate with at least a portion of the interior surface of the shell. The liner includes means for enabling control displacement of preselected regions of the liner upon various degrees of impact to the protective device. The control displacement means comprises at least one first member, at least one second member. Each of the at least one first and second members having a top surface, a bottom surface and a different impact absorbing characteristic. The top surface of at least one of the first and second members is associated with the interior surface of the shell. At least a portion of the bottom surface of the at least one first member extends further from the interior surface of the shell and the bottom surface of the at least one second member.

In a preferred embodiment, the at least one second member further includes means for retaining the at least one first member in the desired orientation. In such a preferred embodiment, the retaining means comprises a compression fit. In another embodiment, the retaining means may comprise an interference fit. In yet another preferred embodiment, the retaining means may comprise an adhesive.

Preferably, the at least one first member includes means for absorbing and dissipating repetitive impacts imparted thereupon. In a preferred embodiment, the second member further includes means for absorbing dissipating a severe impact imparted thereupon.

Preferably, one or more of the at least one second members comprises at least one opening extending therethrough. Further, one or more of the at least one first member has a portion positioned within the at least one opening of the at least one second member. In such an embodiment, the at least one second member may further include a plurality of openings extending therethrough, and a plurality of first members. Each first member extends through one of the plurality of openings in the at least one second member. Preferably, the second member further includes means for retaining the at least one first member within one of the plurality of openings of the at least one second member. The retaining means may comprise a compression fit. Likewise, the retaining means may comprise an interference fit. Further, the retaining means may comprise an adhesive.

In a preferred embodiment, the at least one first member includes a plurality of first members to fully support the protective device on an object to be protected prior to impact. Such a structure precludes contact of the at least one second member with the object to be protected.

In another preferred embodiment, the at least one first member comprises a plurality of first members. The bottom surface of each of the first members extends a substantiality identical distance away from the bottom surface of the at least one second member, so as to uniformly cradle the object to be protected.

Preferably, the protective device comprises a helmet. In a preferred embodiment, the at least one second member is capable of dissipating higher degrees of impact than the at least one first member. Preferably, the at least one first member comprises one of the group consisting of: polypropylene, polystyrene, polyurethane and high density polymers. The at least one second member preferably comprises one of the group consisting of: vinyl nitrile and low density polymers.

BRIEF DESCRIPTION OF THE DRAWINGS

FIG. 4 is a sectional view of the protective helmet and a corresponding exploded view of the liner according to one embodiment of the present invention;

FIG. 5 is a sectional view of the protective helmet and a corresponding exploded view of the liner according to a second embodiment of the present invention;

DETAILED DESCRIPTION OF THE INVENTION

Figure 1:
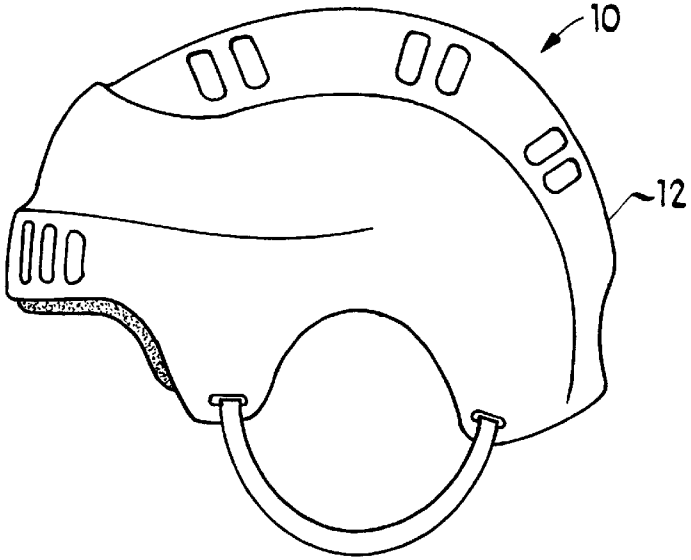
FIG. 1 is a side elevational view of the protective helmet according to the present invention.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments so illustrated.

Figure 2:
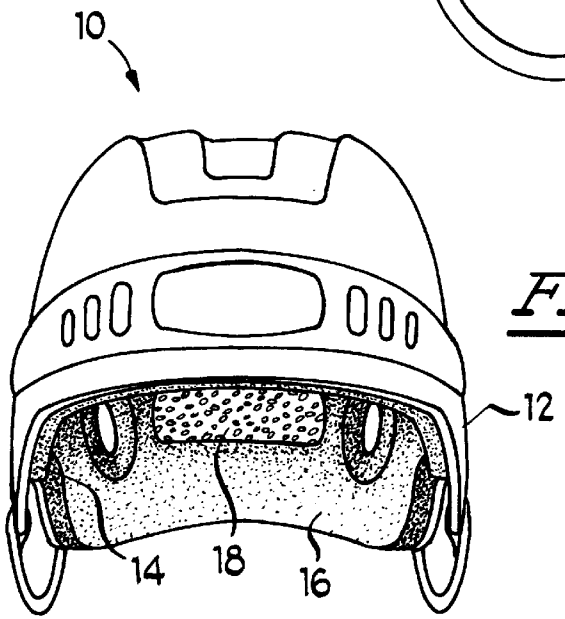
FIG. 2 is a front elevational view of the protective helmet according to the present invention.

Protective device 10 is shown in FIGS. 1 and 2 as comprising outer shell 12, liner 14, and a means associated with the liner for enabling controlled displacement of preselected regions of the liner upon various degrees of impact to the outer shell. Although a protective hockey helmet will be described in detail, it will be understood that the protective device is not limited to use in association with helmets, or even sports.

Outer shell 12 preferably comprises of a high strength plastic material that is specifically designed to absorb an impact imparted thereto—although other conventionally used helmet shell materials are likewise contemplated—and has inner surface 13. It is also contemplated, however, that the outer shell may comprise any covering, including but not limited to other polymers, plastics, ceramics or even soft materials such as fabric or clothing, to accommodate different applications.

Figure 3:
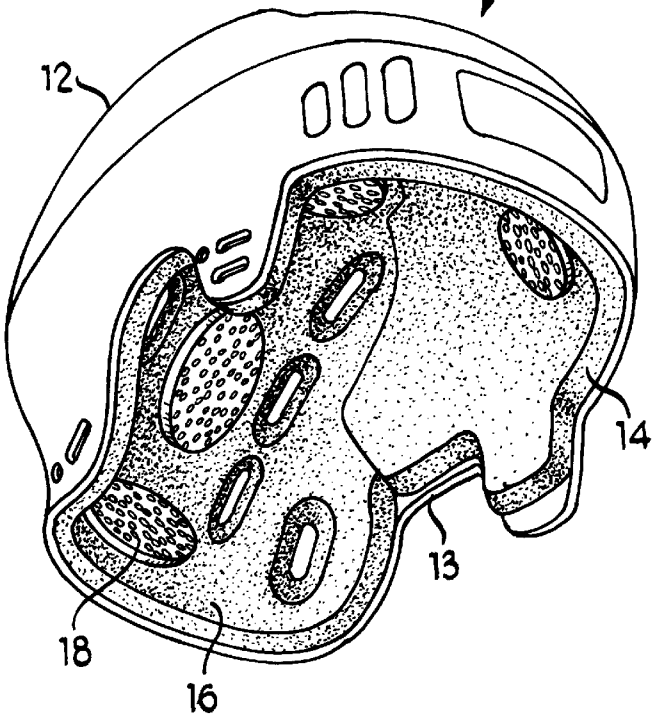
FIG. 3 is a perspective view of the protective helmet according to the present invention.

As is shown in FIG. 3, liner 14 is attached to interior surface 13 of outer shell 12 by the hook and loop attachment means marketed under the trade name VELCRO. Though VELCRO is preferred, other attachment or adhesive means such as snaps, screws, rivets, glue, paste or tape are also contemplated for use in joining liner 14 to outer shell 12.

Liner 14 and associated controlled displacement means are also shown in FIG. 3 as comprising first material 16 and second material 18. First material 16 is fabricated from a material capable of absorbing and dissipating higher degrees of impact imparted upon outer shell 12, relative to the impact absorbing and dissipating characteristics of second material 18. Specifically, first material 16 is capable of absorbing and dissipating a single relatively high impact imparted on the outer shell. In a preferred embodiment, first material 16 is fabricated at least partially from polypropylene. However, other materials such as polystyrene, polyeurothane, or other relatively high density polymers are capable of use in the current invention.

Conversely, second material 18 is fabricated from a material capable of absorbing and dissipating lower degrees of impact imparted upon outer shell 12, relative to the impact absorbing and dissipating characteristics of first material 16. In particular, second material is capable of effectively absorbing and dissipating repetitive impact imparted upon the outer shell. Preferably, second material 18 is fabricated at least partially from vinyl nitrile, however, other relatively low density polymers are suitable for use with the current invention.

Together, first material 16 and second material 18 act in combination to effectively and controllably absorb, displace, and dissipate varying degrees and ranges of impact imparted on outer shell 12.

First material 16, also shown in FIGS. 4–10, has a bottom surface 20, a top surface 22, and a thickness 24. Top surface 22 of first material 16 is positioned adjacent to interior surface 13 of outer shell 12. At least one hole 25 extends through the thickness 24 of the first material 16, although a series of holes 25 are preferred. In a preferred embodiment, there are two different types of holes, plug holes 25 and ventilation holes 26. Plug holes 25 receive plugs 19 fabricated from the second material 18 (hereinafter referred to as second materials plugs), while ventilation holes 26 remain open and are aligned with ventilation holes 45 in the outer shell 12. Alignment of ventilation holes 26 in the first material 18 with ventilation holes 45 in the outer shell 12 facilitates air flow through the helmet 11, to, in turn, cool a wearer's head.

Second material 18, shown in FIG. 4, also has a bottom surface 30, a top surface 32, and a thickness 34. Second material plugs 19 are positioned in plug holes 25 and secured by an interference fit such that top surface 32 of second material 18 is also positioned adjacent to interior surface 13 of outer shell 12. However, bottom surface 30 of second material 18 extends further away from the interior surface of outer shell 12 than bottom surface 20 of first material 16. Accordingly, the configuration of first and second materials results in second material thickness 34 that is greater than first material thickness 24. Although not shown, additional securement can be accomplished with adhesive.

Figure 12:
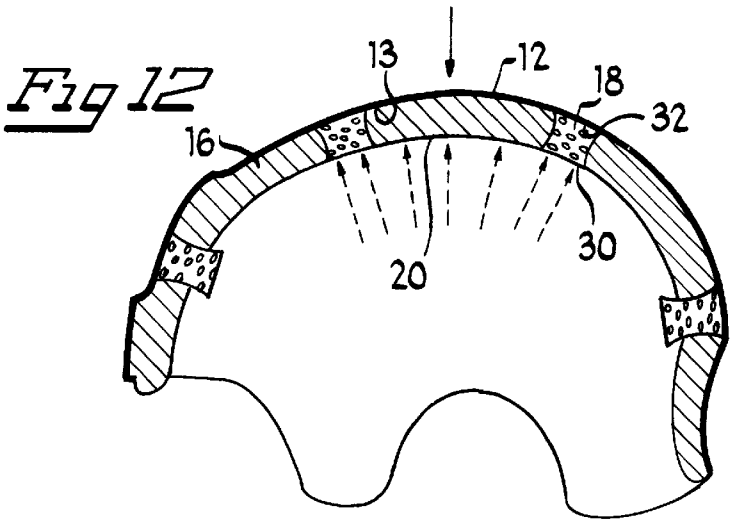
FIG. 12 is a sectional view of the protective helmet upon a relatively high degree of impact.
Figure 11:
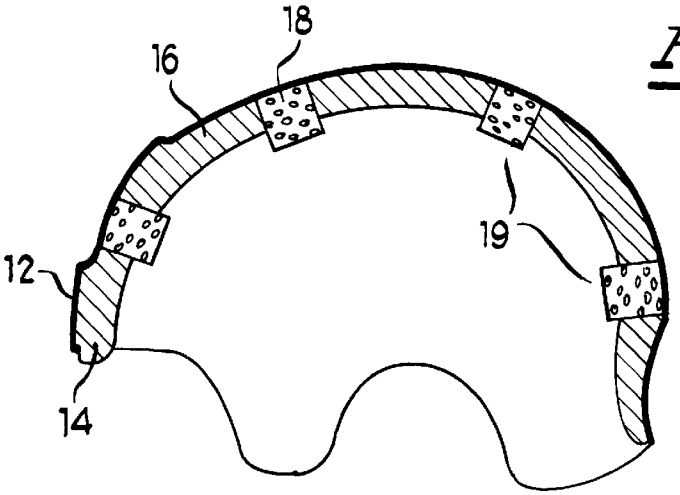
FIG. 11 is a sectional view of the protective helmet upon a relatively low degree of impact.
Figure 11:
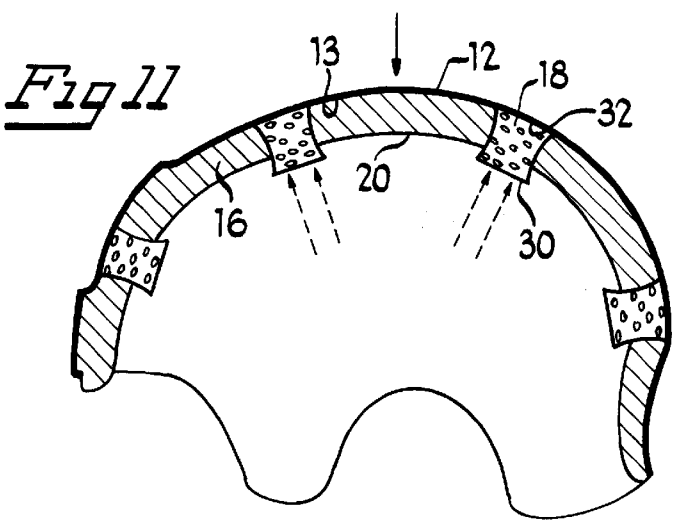

Such a configuration creates the improved ability to controllably absorb, displace, and dissipate a varying range of impacts over an extended period of time. As is shown in FIGS. 11 and 12, impact imparted upon outer shell 12 of the helmet first forces compression of second material 18, which has a bottom surface extending further from interior surface 13 of outer shell 12, and maintains primary contact with a wearer's head. If the impact is of a relatively low degree (FIG. 11), the second material absorbs and displaces the impact such that bottom surface 30 of second material 18 merely returns to its original position in preparation for additional impacts.

If, however, an impact forces compression of the second material such that the distance between interior surface 13 of outer shell 12 and bottom surface 30 of second material 18 is equal to or less than the distance between interior surface 13 of outer shell 12 and bottom surface 20 of first material 16, first material 16 operatively and effectively absorbs, displaces, and dissipates further compression resulting from the impact upon the outer shell (see FIG. 12).

Furthermore, such a configuration also places the head of a wearer of protective helmet in primary contact with the second material, a softer and more user-friendly material. Accordingly, the wearer experiences a more comfortable fit.

Figure 6:
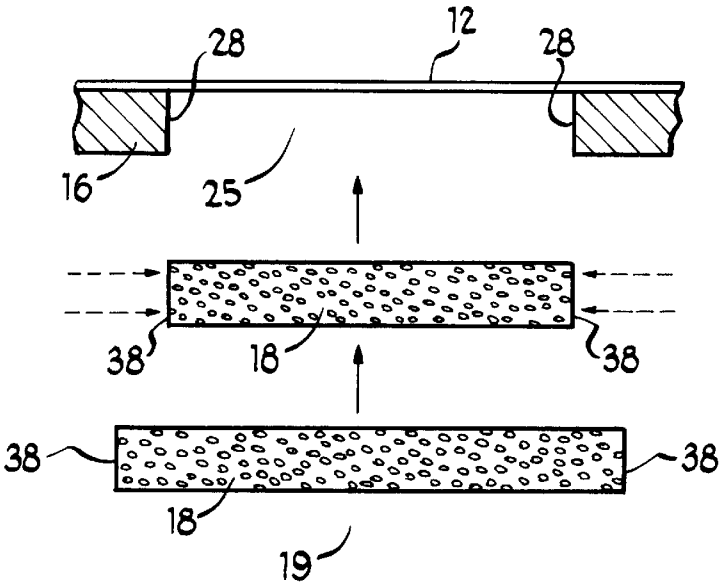
FIG. 6 is a sectional view of the protective helmet and a corresponding exploded view of the liner according to a third embodiment of the present invention.

Referring now to FIGS. 4–6, the interference fit of second material plugs 19 into first material plug holes 25 comprises of the plug holes having a desired shape and an inner peripheral surface 28, which, in turn, has a circumference (it will be understood that the term circumference, though generally associated with a substantially circular shape, also applies to the perimeter of a plug hole which is not necessarily substantially circular in shape—as the plug holes of the current invention are not limited to any specific shape). In one preferred embodiment of this invention (see FIG. 4), the first material plug hole is configured so as to have a ridge 27 associated with at least a portion of inner peripheral surface 28.

Each first material plug hole 25 is associated with a corresponding second material plug 19, with each plug 19 having a shape and an outer peripheral surface 38, which, in turn, has an outer circumference (likewise, the same interpretation of the term circumference will be understood to apply in the case of the plugs). Also in the present embodiment, second material plug 19 is configured so as to have a groove 37 in at least a portion of outer peripheral surface 38. Groove 37 is configured for alignment with ridge 27 of a corresponding first material plug hole 25. Upon insertion of second material plug 19 into first material plug hole 25, groove 37 operatively cooperates with corresponding ridge 27 to form an interference fit. No additional attachment means or adhesion is required to maintain the fit. However, it is certainly contemplated that an adhesive means may be used between the second material plug and the first material plug hole for additional adhesion.

Such an interference fit with a groove configuration in the second material plugs enables maximization of the surface area of bottom surface 30 of second material 18. Accordingly, maximum contact is achieved between the second material and a wearer's head, thus allowing for a helmet with increased comfort and increased impact protection.

In another embodiment, shown in FIG. 5, second material plugs 19 are configured so as to have a ridge 50 in at least a portion of outer peripheral surface 38. Conversely, the corresponding first material plug holes 25 are configured so as to have a groove 52 in at least a portion of inner peripheral surface 28. Like the above preferred embodiment, insertion of the second material plug with a ridged outer peripheral surface into the corresponding first material plug hole with a grooved inner peripheral surface provides a similar secure interference fit.

In yet another embodiment, shown in FIG. 6, the interference fit comprises second material plugs 19 that are larger in at least one circumferential dimension than the corresponding first material plug holes 25, while also having shapes that are substantially similar to the shapes of the corresponding first material plug holes. Accordingly, the size differential in at least one circumferential dimension of the plug and hole shapes forces the second material plug to be operatively compressed and oriented before insertion into the corresponding first material plug hole. Therefore, after insertion of the compressed second material plug into the first material plug hole, the second material plug undergoes a slight expansion, in turn forcing at least a portion of outer peripheral surface 38 of the second material plug into substantial and gripping contact with inner peripheral surface 28 of the first material plug hole. Again, an independent adhesive is not required to hold the plug in place during helmet use, although one may certainly be used.

Aside from the impact absorbing and dissipating advantages described hereinabove, the interference fit has additional advantages such as ease of assembly and replaceability of parts. The second material plugs simply "pop" into the first material plug holes with very little effort, and can be removed with ease as well. This replaceability, in turn, allows the wearer of the helmet to replace the plugs for any number of different reasons, including fit, comfort, or wear and tear.

Also in a preferred embodiment, shown in FIGS. 4–10, first material plug holes 25 and corresponding second material plugs 19 are strategically located so as to provide optimal impact absorption and dissipation, while at the same time providing optimal stabilization of and comfort for a wearer's head. Preferably, the plug holes and plugs are positioned so that bottom surfaces 30 of the second material plugs come into contact with critical portions—such as the occipital, frontal, parietal, and temporal regions—of the wearer's head.

Figure 8:
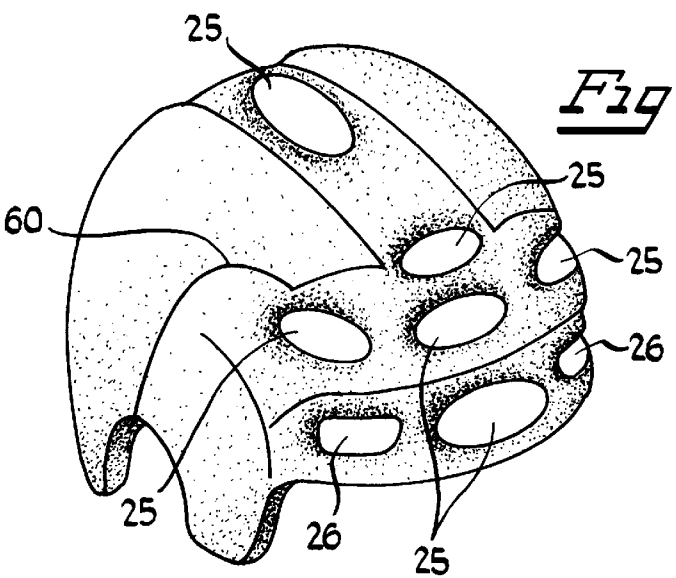
FIG. 8 is a perspective view of the first material front and rear liner pieces matingly engaged to form the first material portion of the liner.
Figure 10:
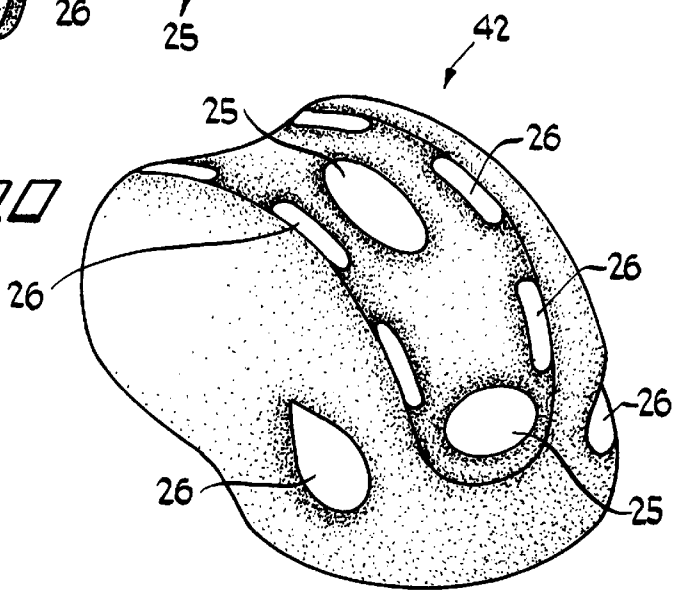
FIG. 10 is a perspective view of the first material rear liner piece according to FIG. 9.
Figure 7:
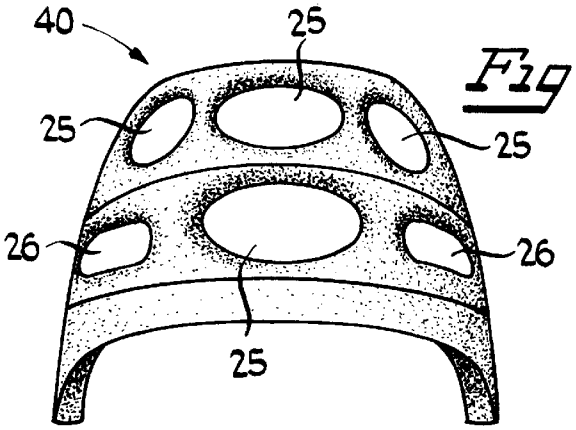
FIG. 7 is a front elevational view of the first material front liner piece according to an embodiment of the present invention.
Figure 9:
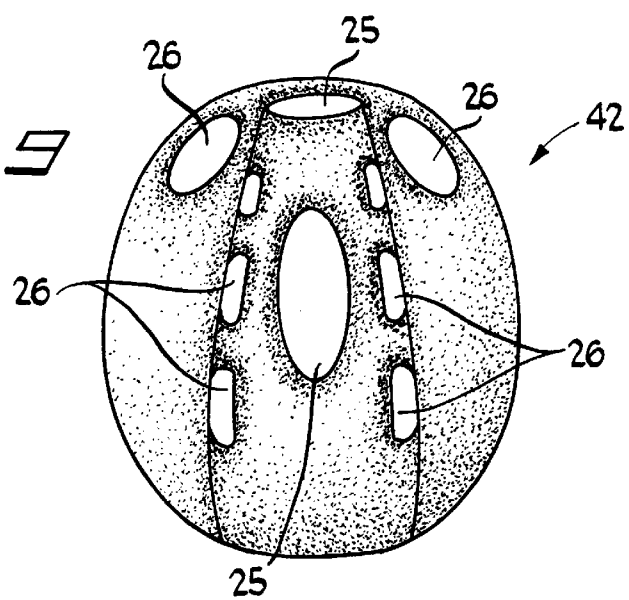
FIG. 9 is a top plan view of the first material rear liner piece according to another embodiment of the present invention.

In another embodiment, shown in FIGS. 7–10, liner 14 may comprise of both a front piece 40 and a back piece 42, which fit matingly together (see FIG. 8). The two pieces operatively come together and overlap along joinder line 60. This overlapping orientation allows the liner to effectively and controllably absorb and displace impact imparted on outer shell 12 in the area of joinder liner 60. Such a multiple piece construction allows for both greater ease and less expense in manufacturing the liner.

What is claimed is:

1. A protective device comprising:

a shell including an interior surface; and a liner associated with at least a portion of the interior surface of the shell, the liner including means for enabling controlled displacement of preselected regions of the liner upon various degrees of impact to the protective device, the controlled displacement means comprising:

at least two first members and at least one second member, each having a top surface and a bottom surface, each of the at least two first members having a different impact absorbing characteristic than the at least one second member, the bottom surfaces of each of the at least two first members being independently movable relative to each other and in mating engagement with the at least one second member, the top surface of at least one of the at least one first and second member, being associated with the interior surface of the shell, and at least a portion of the bottom surface of the at least two first members extending further from the interior surface of the shell than the bottom surface of the at least one second member.

2. The invention according to claim 1 wherein the at least one second member further includes means for retaining the at least two first member in a desired orientation.

3. The invention according to claim 2 wherein the retaining means comprises a compression fit.

4. The invention according to claim 2 wherein the retaining means comprises an interference fit.

5. The invention according to claim 2 wherein the retaining means comprises an adhesive.

6. The invention according to claim 1wherein the at least two first member includes means for absorbing and dissipating repetitive impacts imparted thereupon.

7. The invention according to claim 1 wherein the second member further includes means for absorbing and dissipating a severe impact imparted thereupon.

8. The invention according to claim 1 wherein:

one or more of the at least one second member includes at least one opening extending therethrough; and one or more of the at least two first member has a portion positioned within the at least one opening of the at least one second member.

9. The invention according to claim 8 wherein:

the at least one second member includes a plurality of openings extending therethrough; and further including:

a plurality of first members, wherein each first member extends through one of the plurality of openings of the at least one second member.

10. The invention according to claim 9 wherein the second member further includes means for retaining the at least two first member within one of the plurality of openings of the at least one second member.

11. The invention according to claim 10 wherein the retaining means comprises a compression fit.

12. The invention according to claim 10 wherein the retaining means comprises an interference fit.

13. The invention according to claim 10 wherein the retaining means comprises an adhesive.

14. The invention according to claim 1 wherein the at least two first members includes a plurality of first members to fully support the protective device on an object to be protected prior to impact, and, in turn, to preclude contact of the at least one second member with the object to be protected.

15. The invention according to claim 1 wherein the at least two first member comprises a plurality of first members, the bottom surface of the first members each extending a substantially identical distance away from the bottom surface of the at least one second member, to in turn, uniformly protect an object to be protected.

16. The invention according to claim 1 wherein the protective device comprises a helmet.

17. The invention according to claim 1 wherein the at least two second members is capable of dissipating higher degrees of impact than the at least one first member.

18. The invention according to claim 1 wherein the at least one first member comprises one of the group consisting of: polypropylene, polystyrene, polyurethane, and high density polymers.

19. The invention according to claim 1when the at least two second member comprises one of the group consisting of: vinyl nitrile and low density polymers.

20. A protective device comprising:

a shell including an interior surface; and a liner associated with at least a portion of the interior surface of the shell, the liner including means for enabling controlled displacement of preselected regions of the liner upon various degrees of impact to the protective device, the controlled displacement means comprising:

at least two first members and at least one second member, each having a top surface and a bottom surface, each of the at least two first members having a uniform and different impact absorbing characteristic than the at least one second member, the top surface of at least one of the at least one first and second member, being associated with the interior surface of the shell, and at least a portion of the bottom surface of the at least two first members extending further from the interior surface of the shell than the bottom surface of the at least one second member.

* * * * *

UNITED STATES PATENT AND TRADEMARK OFFICE

CERTIFICATE OF CORRECTION

PATENT NO. : 5,950,244

DATED : September 14, 1999

INVENTOR(S) : Fournier et al.

It is certified that error appears in the above-identified patent and that said Letters Patent is hereby corrected as shown below:

| | |
|---|---|
| Col. 6 line 55 | Delete the word "member" and insert instead – members –. |
| Col. 6 line 63 | Delete the word "member" and insert instead – members –. |
| Col. 7, line 4 | Delete the word "member" and insert instead – members –. |
| Col. 7, line 16 | Delete the word "member" and insert instead – members –. |
| Col 7, line 31 | Delete the word "member" and insert instead – members –. |
| Col. 8, line 4 | Delete the word "second" and insert instead – first –. |
| Col. 8 line 11 | Delete the words "second member" and insert instead – first members –. |

Signed and Sealed this

Nineteenth Day of September, 2000

*Attest:*

Q. TODD DICKINSON

*Attesting Officer*

*Director of Patents and Trademarks*